US006494532B1

(12) United States Patent
Brosnan et al.

(10) Patent No.: US 6,494,532 B1
(45) Date of Patent: Dec. 17, 2002

(54) SOFT-SCULPTED FURNITURE

(75) Inventors: Judith J. Brosnan, Chicago, IL (US); Scott T. Haugh, Lockport, IL (US)

(73) Assignee: J. Rhee Chuen, Chicago, IL (US)

( * ) Notice: Subject to any disclaimer, the term of this patent is extended or adjusted under 35 U.S.C. 154(b) by 0 days.

(21) Appl. No.: 08/951,347

(22) Filed: Oct. 16, 1997

(51) Int. Cl.[7] ..... A63G 9/10
(52) U.S. Cl. ..... 297/181; 297/452.17
(58) Field of Search ..... D6/359; 297/181, 297/464, 487, 488, 256.15, 452.17, 452.41

(56) References Cited

U.S. PATENT DOCUMENTS

| | | | | | |
|---|---|---|---|---|---|
| 2,987,735 | A | * | 6/1961 | Nail | 297/452.41 X |
| D227,424 | S | * | 6/1973 | Ando | |
| 3,767,259 | A | * | 10/1973 | Blake et al. | |
| 3,840,916 | A | * | 10/1974 | Jennings | |
| 3,893,731 | A | * | 7/1975 | Maggs | 297/452.17 |
| 4,011,611 | A | * | 3/1977 | Lederman | 297/452.17 X |
| 4,027,888 | A | * | 6/1977 | Wilcox | 297/452.17 |
| 4,213,213 | A | * | 7/1980 | Burnett | |
| D259,902 | S | * | 7/1981 | Rock | |
| 4,586,747 | A | | 5/1986 | Taylor | 297/250 |
| D290,430 | S | * | 6/1987 | Kullberg | |
| 4,695,092 | A | | 9/1987 | Hittie | 297/230 |
| D294,099 | S | | 2/1988 | Bromberg et al. | D6/611 |
| 4,739,529 | A | | 4/1988 | Mills | 5/413 |
| 4,759,588 | A | | 7/1988 | Husnik | 297/468 |
| 4,776,049 | A | | 10/1988 | Perron | 5/436 |
| 4,802,900 | A | * | 2/1989 | Ball et al. | |
| 4,875,732 | A | * | 10/1989 | Miller | |
| 4,909,573 | A | | 3/1990 | Barry et al. | 297/456 |
| D309,988 | S | * | 8/1990 | Oscar | |
| 5,027,457 | A | | 7/1991 | Sweet | 5/437 |
| 5,112,104 | A | | 5/1992 | DeGiacomi | 297/229 |
| 5,137,335 | A | | 8/1992 | Martin | 297/485 |
| 5,147,109 | A | | 9/1992 | Jolly | 297/217 |
| D359,170 | S | * | 6/1995 | Lyons et al. | |
| 5,551,749 | A | | 9/1996 | Reher et al. | 297/219.12 |
| 5,729,851 | A | * | 3/1998 | Hollander | |

* cited by examiner

*Primary Examiner*—Milton Nelson, Jr.
(74) *Attorney, Agent, or Firm*—Michael Best & Friedrich LLC

(57) ABSTRACT

Soft-sculpted furniture, such as a chair, having unstructured seat and back portions and two arm portions. The chair can be in the form of a soft-sculpted animal or other figures or characters. The arm portions are contoured to follow the contour of the seat and back portions, are connected between the seat portion and back portion, and are constructed so that the chair provides support for a user in a seated upright position without the need for an internal frame structure. The arm portions are configured to extend outward when the chair is not in use to give the appearance of the figure inviting the user to sit in the chair. The arms can be wrapped around the user when in the chair and are wide enough to cover a substantial portion of the user so as to serve as a blanket or cover.

5 Claims, 4 Drawing Sheets

SOFT-SCULPTED FURNITURE

FIELD OF THE INVENTION

The present invention relates to furniture. More particularly, the present invention relates to soft-sculpted furniture which is self-supporting.

BACKGROUND OF THE INVENTION

Various car seats, chairs and chair covers have been proposed in the shape of an animal or fictional character with limbs, such as arms or legs, that wrap around and hug a child while in an upright seated position. Many of the proposed devices fail to provide adequate support and stabilization in supporting the child. In order to add support, other devices have included a rigid internal skeletal frame. However, rigid internal frames present an injury risk for children using these devices.

U.S. Pat. No. 4,909,573, issued to Barry et al. discloses a child's chair in the form of an animal. The chair includes a rigid frame covered by a cushion in the form of an animal. The animal cushion has a body with upper and lower limbs in the form of arms and legs. The rigid frame includes structural members extending into the arms. In the preferred embodiment of this patent, the cushion is in the form of a bear with flexible arms that can be wrapped around a child seated in the chair. Velcro patches on hands connected to the arms allow the arms to be connected when encircled around the seated child.

This and other prior art devices use some kind of structural member or frame for stability, so that the device will have some degree of rigidity. The prior art also includes so-called beanbag chairs or the like, which are soft and pliable, but lack support to hold a person in a generally upright seated position.

While the above-mentioned devices may be suited for their intended usage, these devices do not provide a soft-sculpted chair with provides sufficient stabilization to support a user in an upright seated position without the use of an internal frame structure. Thus, there is a need for a soft-sculpted chair which supports a user in an upright seated position without using a rigid internal frame structure.

SUMMARY OF THE INVENTION

The present invention provides soft-sculpted furniture, such as a chair, which supports a user in an upright seated position without the use of any internal frame structure. The chair comprises an unstructured contoured seat portion, an unstructured contoured back portion and a pair of contoured arm portions. The back portion is connected to the seat portion to form the body of a soft-sculpted figure such as an animal form. The seat contour includes a leg support section for supporting a user's legs when seated in the chair.

The arm portions are contoured to fit the contour of the seat portion and back portion and are connected between the seat portion and the back portion. The arm portions act to support the back portion in an upright manner without the use of a rigid internal support frame. Preferably, the arm portions extend and are connected along at least one-half of the length of the seat portion and at least one-half of the length of the back portion.

The seat portion, the back portion and the arm portions are filled with a soft stuffing material. In a preferred embodiment, the seat and back portions are filled with a polyester fiber material. The arm portions are filled with bonded polyester sheets folded in such a manner that the arm portions are configured to extend outward when the chair is not in use giving the appearance that the soft-sculpted figure is inviting the user to sit in the chair.

The arm portions are configured to be wrapped around the user when the user is seated in the chair giving the appearance that the soft-sculpted figure is hugging the user. The arm portions are wide enough to cover a substantial portion of the user to act as a blanket when wrapped around the user.

The chair includes a base portion in the seat portion for maintaining the chair in an upright position. In a preferred embodiment, the base portion is rectangular in shape to further maintain the shape and structure of the chair.

The back portion of the chair includes a head portion having a figure face. In one embodiment, the figure face is slightly turned to one side so as not to interfere with a user's head or back when seated in the chair. The chair can also include a tail, ears or other ornamental features adding to the aesthetic qualities of the soft-sculpted figure.

DETAILED DESCRIPTION OF A PREFERRED EMBODIMENT

Figure 1:
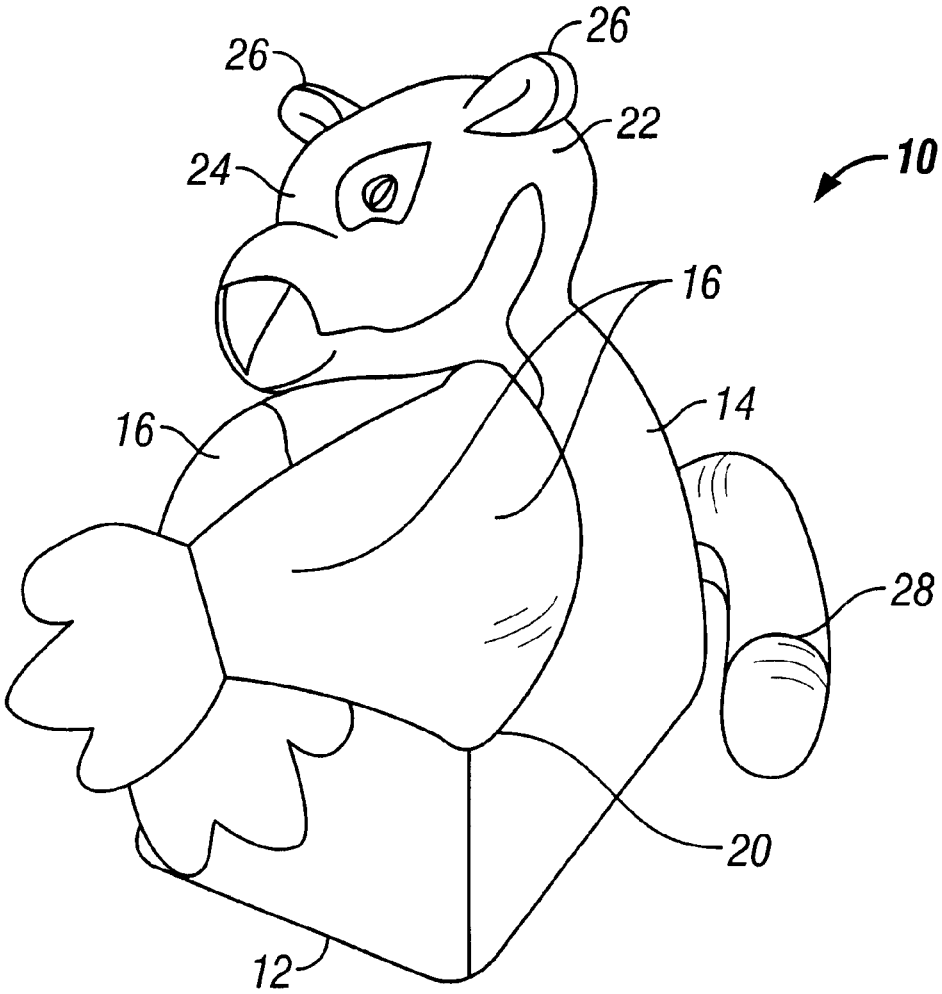
FIG. 1 is a front, perspective view of a preferred embodiment of the present invention.
Figure 2:
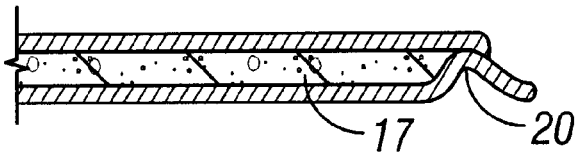
FIG. 2 is a cross-sectional view of the arm to chair Connection of the embodiment shown in FIG. 1.

Referring now to the drawings, a soft-sculpted furniture article, such as a chair, according to the present invention is generally designated 10. The chair 10 comprises an unstructured (having no rigid internal frame structure) contoured seat portion 12, an unstructured contoured back portion 14 and a pair of arm portions 16.

As shown in FIGS. 1 through 6 and 8, one embodiment of chair 10 is soft-sculpted into the form of a leopard. Seat portion 12 and back portion 14 are connected together to form the body of the leopard. Seat portion 12 is contoured to include a leg support section 18 for supporting the user's legs when seated in the chair 10.

Figure 8:
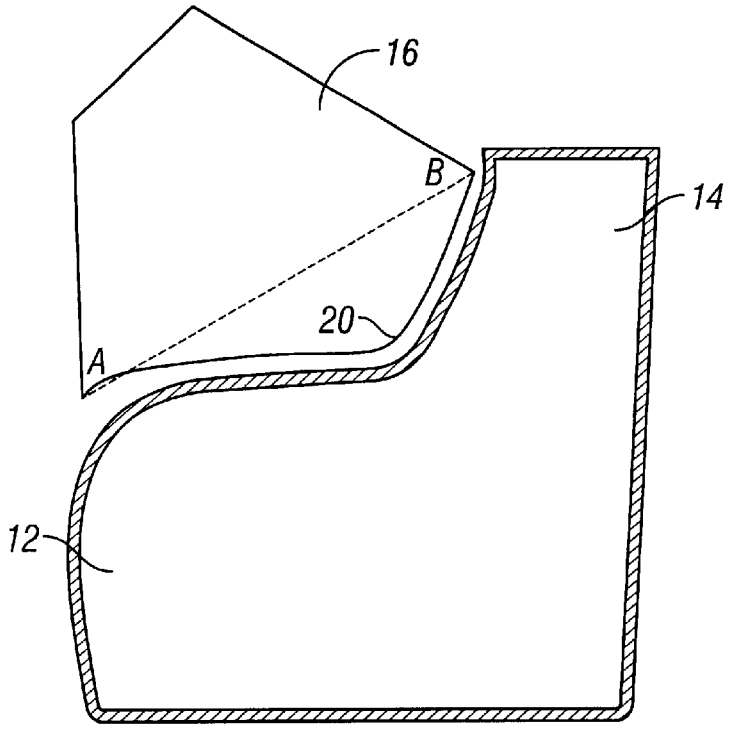
FIG. 8 is an exploded plan view of the material pattern of an arm portion, back portion and seat portion of the embodiment shown in FIG. 1.

Arm portions 16 are connected to the seat portion 12 and back portion 14. Arm portions 16 are contoured to fit the contour of the seat portion 12 and back portion 14 and act to support a user in an upright seated position without the need for a rigid internal frame structure. As shown in FIG. 8, arm portions 16 have a connection edge 20 which is contoured to follow the contours of the seat portion 12 and back portion 14.

Preferably, the arm portions 16 extend and are connected along at least one-half of the length of the seat portion 12 and at least one-half of the length of the back portion 14. In the illustrated embodiment, the arm portions 16 extend and are connected along substantially the entire length of the seat portion 12 and back portion 14.

In this manner, the arm portions 16 act as a sort of restraint on the back portion 14 when pressure is applied to the back portion 14 by a user seated in chair 10. As pressure is applied to the back portion 14 when the user reclines in the chair 10, the arm portion 16 supports the back portion 14 through the connection between the back portion 14 and seat portion 12. The applied pressure is distributed along line A-B in FIG. 8, on the length of the connection edge 20 connected between the seat portion 12 and back portion 14, providing support for the back portion 14 without the need for an internal frame structure.

The seat portion 12, back portion 14, and arm portions 16 comprise a fabric shell, stitched together from various patterns of fabric, which is filled with a soft stuffing material. The shell stitching and soft stuffing material provide the structure of the chair.

Figure 3:
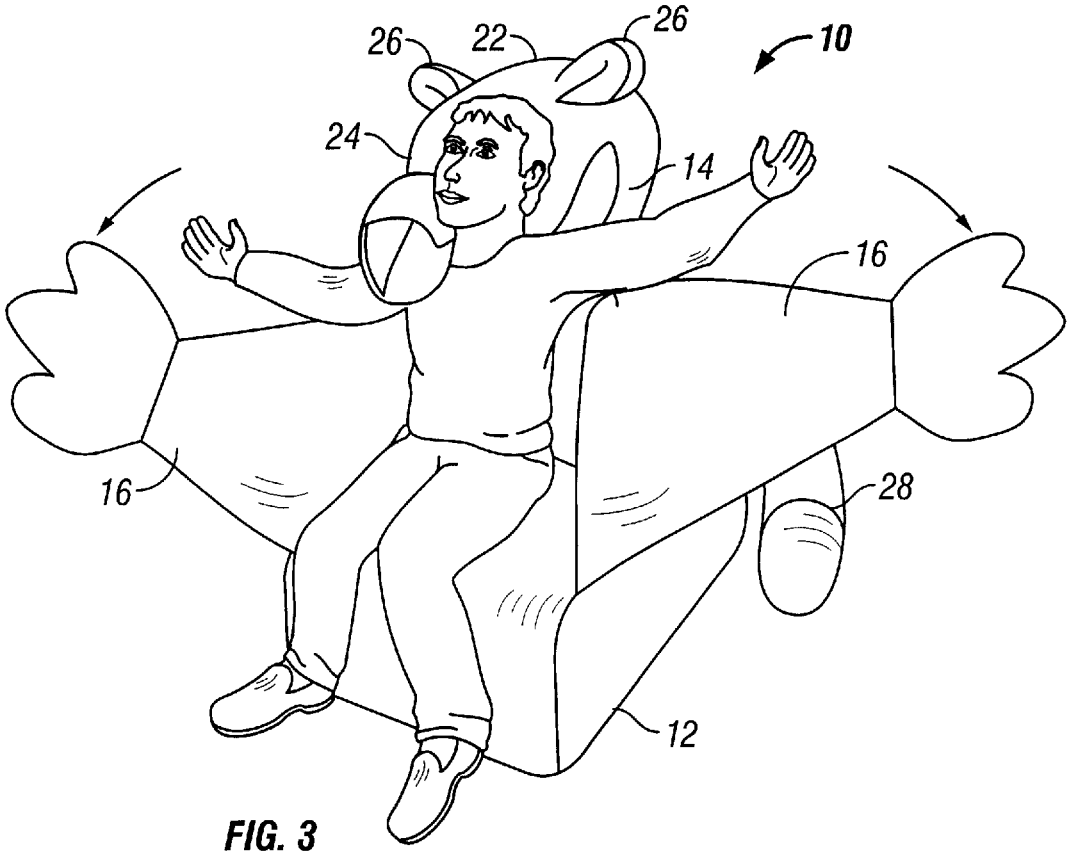
FIG. 3 is a front perspective view of the embodiment shown in FIG. 1 with a user seated in the chair.

In the illustrated embodiment, the seat portion 12 and back portion 14 are filled with a polyester fiber material 15. The arm portions 16 are filled with bonded polyester sheets 17 folded in a manner such that the arm portions 16 extend outward when the chair 10 is not in use giving the appearance that the leopard figure is inviting the user to sit in the chair 10 (FIG. 3). It is important that an appropriate amount of arm stuffing material bonded polyester sheets 17 is used in order to accomplish the open arms appearance.

Figure 4:
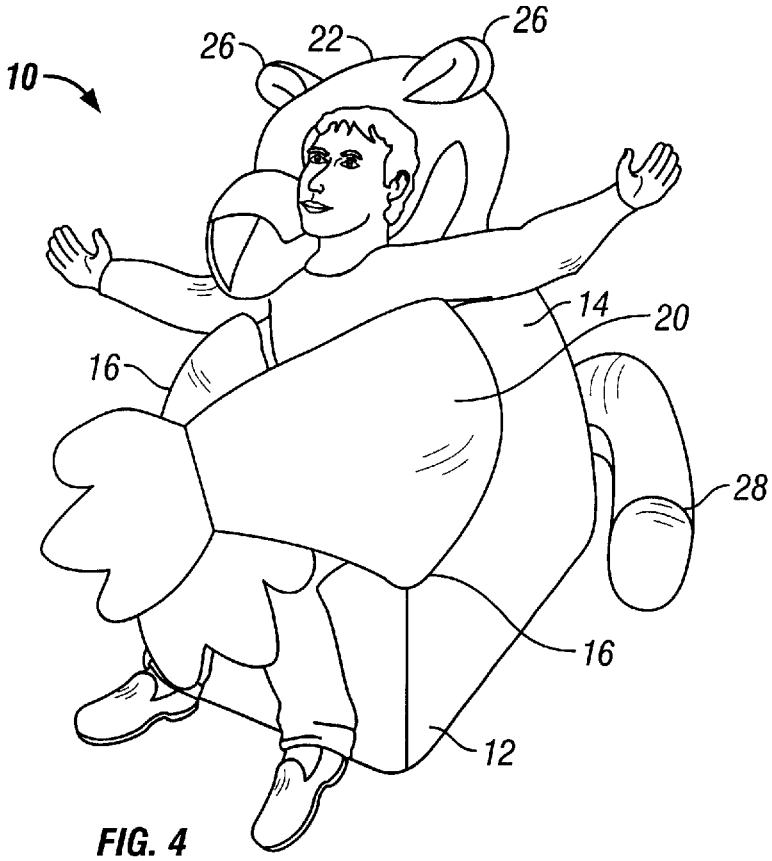
FIG. 4 is a front perspective view of the embodiment shown in FIG. 3 with the figure's arms wrapped around the user.
Figure 5:
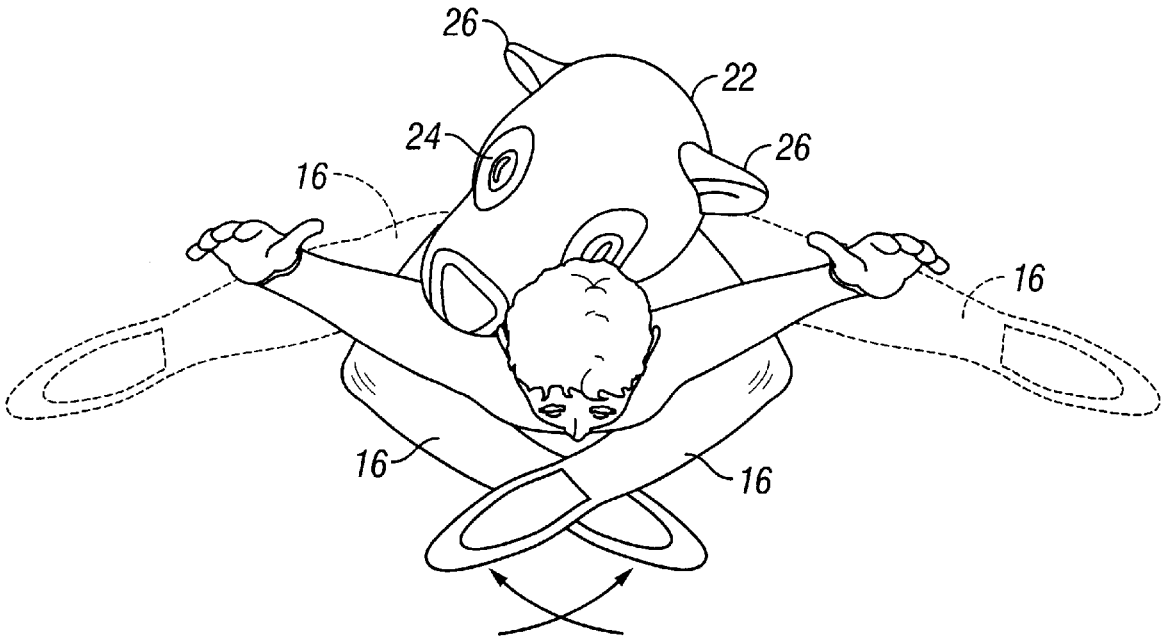
FIG. 5 is a top view of a user seated in the embodiment shown in FIG. 4.

The arm portions 16 are configured to be wrapped around the user when the user is seated in the chair 10, giving the appearance that the leopard is hugging the user (FIG. 4). The arm portions 16 are wide enough to cover a substantial portion of the user to act as a blanket when wrapped around the user.

Figure 7:
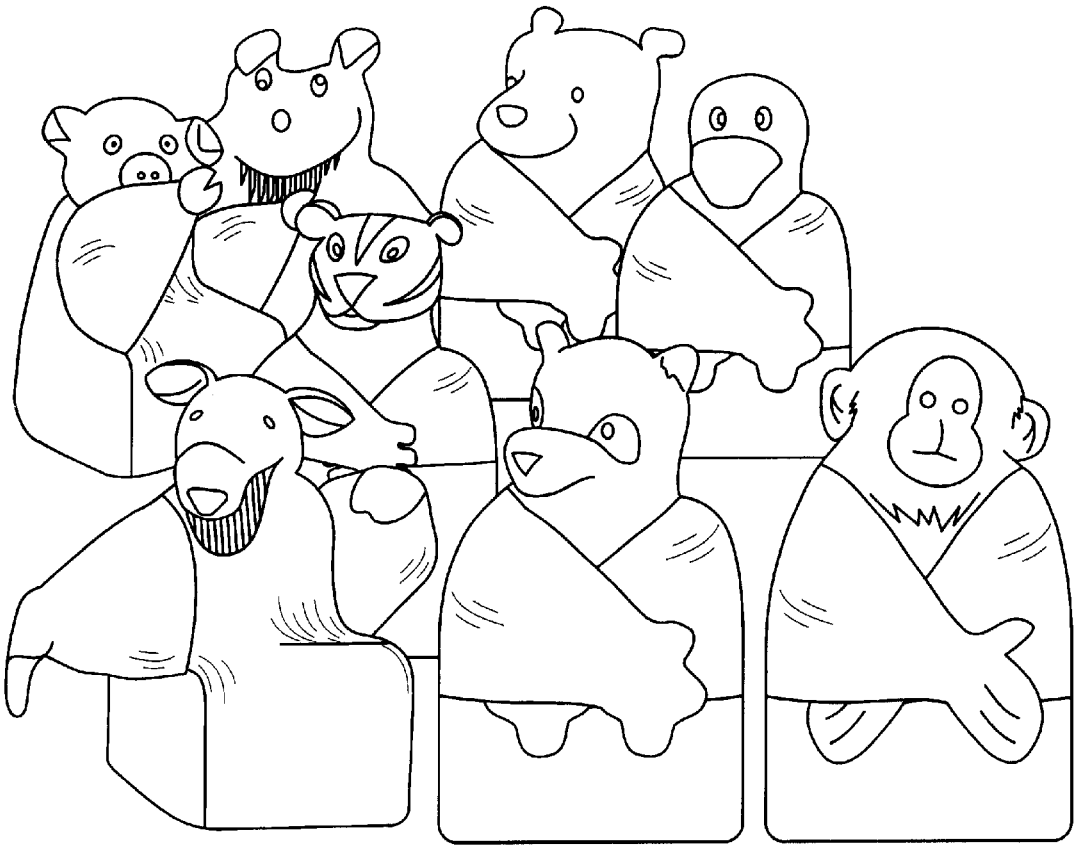
FIG. 7 is a perspective view of alternative soft-sculpted figure embodiments according to the present invention.

The back portion 14 of the chair 10 includes a head portion 22 having a figure face 24. As shown, for example in FIG. 5, the figure face 24 is turned slightly to one side so as not to interfere with the user's head or back when seated in the chair. The chair 10 also includes other ornamental features such as ears 26 and a tail 28 completing the figure's appearance. While the drawings show the chair 10 as having the appearance of a leopard, other animals and characters are contemplated such as those shown in FIG. 7.

Figure 6:
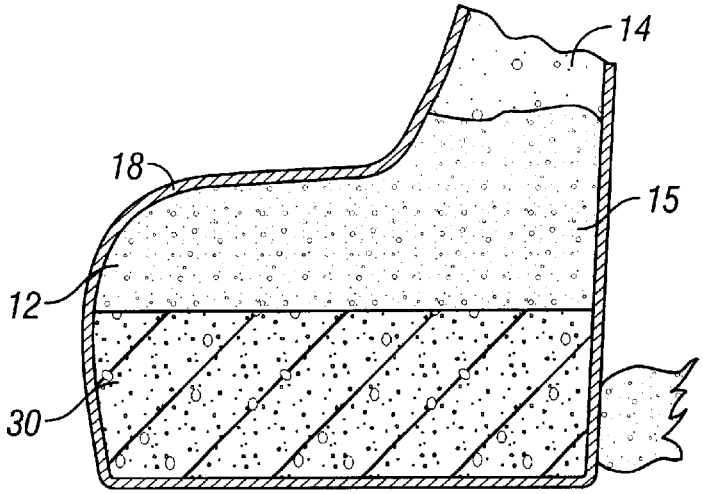
FIG. 6 is a cross-sectional view of the seat portion of the chair shown in FIG. 1.

Referring to FIG. 6, the seat portion 12 of the chair 10 includes a base portion 30 for maintaining the chair 10 in an upright position. In one embodiment, the base portion 30 comprises a solid, rectangular-shaped piece of soft cushion material having a weight substantially greater than the weight of the soft filling material 15. The base portion 30 further maintains the shape and structure of the seat portion 12 of the chair 10.

It will be apparent to those skilled in the art that modifications may be made without departing from the spirit and scope of the invention. Accordingly, it is not intended that the invention be limited except as may be necessary in view of the appended claims.

What is claimed is:

1. A soft-sculpted chair in the form of a character, the chair comprising:

a fabric shell sewn into a character form having a body and arm portions, said body portion including a seat portion and a back portion; and soft stuffing material held within said fabric shell, said arm portions being connected to said seat portion and said back portion for supporting said back portion in an upright manner without the need for an internal support structure.

2. The soft-sculpted chair of claim 1 further comprising a base portion held within said seat portion for maintaining the chair in an upright position.

3. The soft-sculpted chair of claim 2, wherein said base portion and said soft stuffing material are made of different materials.

4. The soft-sculpted chair of claim 1 wherein said fabric shell further comprises a head portion having a figure face.

5. The soft-sculpted chair of claim 1 wherein said arm portions are connected to said back portion and said seat portion by sewing said arm portions to said back portion and said seat portion.

* * * * *